US007518048B2

(12) United States Patent
Murray

(10) Patent No.: US 7,518,048 B2
(45) Date of Patent: Apr. 14, 2009

(54) NECK AND BODY ATTACHMENTS FOR STRINGED MUSICAL INSTRUMENTS

(75) Inventor: Patrick Murray, Marriottsville, MD (US)

(73) Assignee: Pat Murray Guitar Company, Marriottsville, MD (US)

( * ) Notice: Subject to any disclaimer, the term of this patent is extended or adjusted under 35 U.S.C. 154(b) by 199 days.

(21) Appl. No.: 11/581,746

(22) Filed: Oct. 17, 2006

(65) Prior Publication Data

US 2007/0131081 A1 Jun. 14, 2007

Related U.S. Application Data

(60) Provisional application No. 60/726,650, filed on Oct. 17, 2005.

(51) Int. Cl.
*G10D 3/00* (2006.01)

(52) U.S. Cl. ..... 84/291; 84/293

(58) Field of Classification Search ..... 84/283, 84/291, 290

See application file for complete search history.

(56) References Cited

U.S. PATENT DOCUMENTS

| | | | | |
|---|---|---|---|---|
| 498,113 | A | 5/1893 | Hartmann | |
| 3,657,462 | A | 4/1972 | Robinson | |
| 4,073,211 | A | 2/1978 | Jorgensen | |
| 4,126,073 | A | 11/1978 | Takabayashi | |
| 4,172,405 | A | 10/1979 | Kaman, II | |
| 4,295,403 | A | 10/1981 | Harris | |
| 4,377,962 | A | 3/1983 | Parker | |
| 4,432,267 | A | 2/1984 | Feller | |
| 4,803,906 | A | 2/1989 | Fender | |
| 4,939,970 | A | 7/1990 | Hoshino et al. | |
| 5,347,904 | A | 9/1994 | Lawrence | |
| 5,353,672 | A | 10/1994 | Stewart | |
| 5,452,637 | A | 9/1995 | DeCola | |
| 5,661,252 | A | 8/1997 | Krawczak | |
| D400,563 | S | 11/1998 | Jones | |
| 5,886,272 | A * | 3/1999 | Regenberg | 84/293 |
| 5,973,242 | A | 10/1999 | Spezia | |
| 6,025,548 | A | 2/2000 | Ehrlich | |
| 6,028,255 | A | 2/2000 | Myronyk | |
| 6,051,766 | A | 4/2000 | Taylor | |
| 6,262,353 | B1 | 7/2001 | Murray | |
| 6,897,366 | B2 | 5/2005 | McPherson | |
| 6,911,590 | B2 | 6/2005 | Childress | |

OTHER PUBLICATIONS

International Search Report dated May 15, 2007 for International Application No. PCT/US2006/040651.

* cited by examiner

*Primary Examiner*—Kimberly R Lockett
(74) *Attorney, Agent, or Firm*—Hogan & Hartson LLP

(57) ABSTRACT

An improved system and method for connecting separate neck and body portions of a stringed musical instrument, preferably an electric guitar, are provided. The neck and body portions are connected together via a support bracket having multiple planes with screws, bolts or the like that are preferably located underneath a cover plate on the front side of the instrument. The instrument includes no other visible securing members, such that separate neck and body portions can be connected together while maintaining a one-piece aesthetic quality of the instrument.

20 Claims, 6 Drawing Sheets

NECK AND BODY ATTACHMENTS FOR STRINGED MUSICAL INSTRUMENTS

CROSS REFERENCE TO RELATED APPLICATIONS

This application claims priority under 35 U.S.C. § 119(e) from U.S. Provisional Patent Application Nos. 60/726,650, filed on Oct. 17, 2005, which is incorporated herein in its entirety by reference.

STATEMENT REGARDING SPONSORED RESEARCH OR DEVELOPMENT

Not Applicable.

REFERENCE TO SEQUENCE LISTING

Not Applicable.

BACKGROUND OF THE INVENTION

1. Field of the Invention

The present invention relates generally to stringed musical instruments and, more specifically, to an improved stringed musical instrument and method of making a stringed musical instrument, especially an electric stringed instrument (e.g., an electric guitar), having attached neck and body portions.

2. Description of Related Art

There are numerous types of stringed instruments, e.g., guitars, banjos, etc., known in the art. Typically, guitars, for example, are constructed with two distinct portions—a wide body portion and a narrow neck portion extending therefrom. The strings of the guitar are typically mounted along the neck of the guitar, with first ends of the strings attached to the body and second ends of the strings attached at a distal end of the neck. The body can be hollow, semi-hollow or solid.

The neck and body portions of a stringed instrument may be connected together via screws, bolts, or other fasteners and the like, and that such connectors may be located underneath a cover plate on the front side of the instrument. Thus, the instrument may be constructed to includes no visible securing members, such that separate neck and body portions can be connected together while maintaining a one-piece aesthetic quality of the instrument. These attachment techniques may sacrifice a certain amount of structural integrity for the improved aesthetic quality.

While a number of neck and body attachments are known in the art, there are a variety of problems with such existing attachments. Among other things, existing attachments can be difficult to assemble, costly to assemble, structurally unsound and aesthetically undesirable. Thus, there exists a continued need in the art for improved neck and body attachment methods and devices.

SUMMARY OF THE INVENTION

An neck and body attachment system and method is provided that may be used to attach the neck and body portions of a stringed musical instrument. In an embodiment of the invention, an L-shaped bracket attachment is employed Portions of the bracket may extend into, around, against or through the surface of the body of the instrument and into, around, against or through the neck portion of the instrument adjacent to or within the body portion of the instrument. Attachments in accordance with embodiments of the invention, provide greater rigidity and strength which provides a variety of benefits, including greater design flexibility. For example, a single bracketed attachment may be used for an attachment of the neck and body of the instrument, in contrast to the traditional use of multiple attachments.

According to a first general aspect of the invention, a method for securing a body portion and an elongated neck of a stringed instrument is provided including the steps of: a) forming a cavity in said body extending to a front surface of said body; b) overlapping a proximal end of said neck and said body such that the proximal end extends behind said cavity; c) inserting a bracket attachment having at least one non-planar extension into said cavity; d) connecting at least one securing member that extends from said cavity through said bracket and said body and partly into said proximal end for attaching said neck to said body; and e) placing a cover element within said cavity over said securing members and said bracket so as to have the front and rear surfaces of said body and neck free of visible securing members.

According to a second general aspect of the invention, a system for a use in securing a body portion and an elongated neck of a stringed instrument is provided that includes: a cavity formed within the body portion; a bracket having at least one non-planar extension; two or more securing members extending from the cavity through said body and bracket in separate planes so as to secure together said body, said neck and said bracket; and a cover element that fits within or over said cavity so as to have the front and rear surfaces of the body and the neck free of visible securing members.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

The detailed description that follows will further describe each aspect of the above invention.

U.S. Pat. No. 6,262,353, which is hereby incorporated by reference, discloses improvements in the design of neck and body attachments for stringed musical instruments. The present invention, however, further advances the art of neck and body attachment. Specifically, various embodiments of the present invention improve the strength and stability of the connection formed when compared to neck and body attachments known in the art. Moreover, certain embodiments of the present invention eliminate the need for multiple neck and body attachment points. Such improvements not only improve the quality of the product, but may also permit greater flexibility in the design, development and manufacture of musical instruments employing neck and body attachments.

Figure 1A:
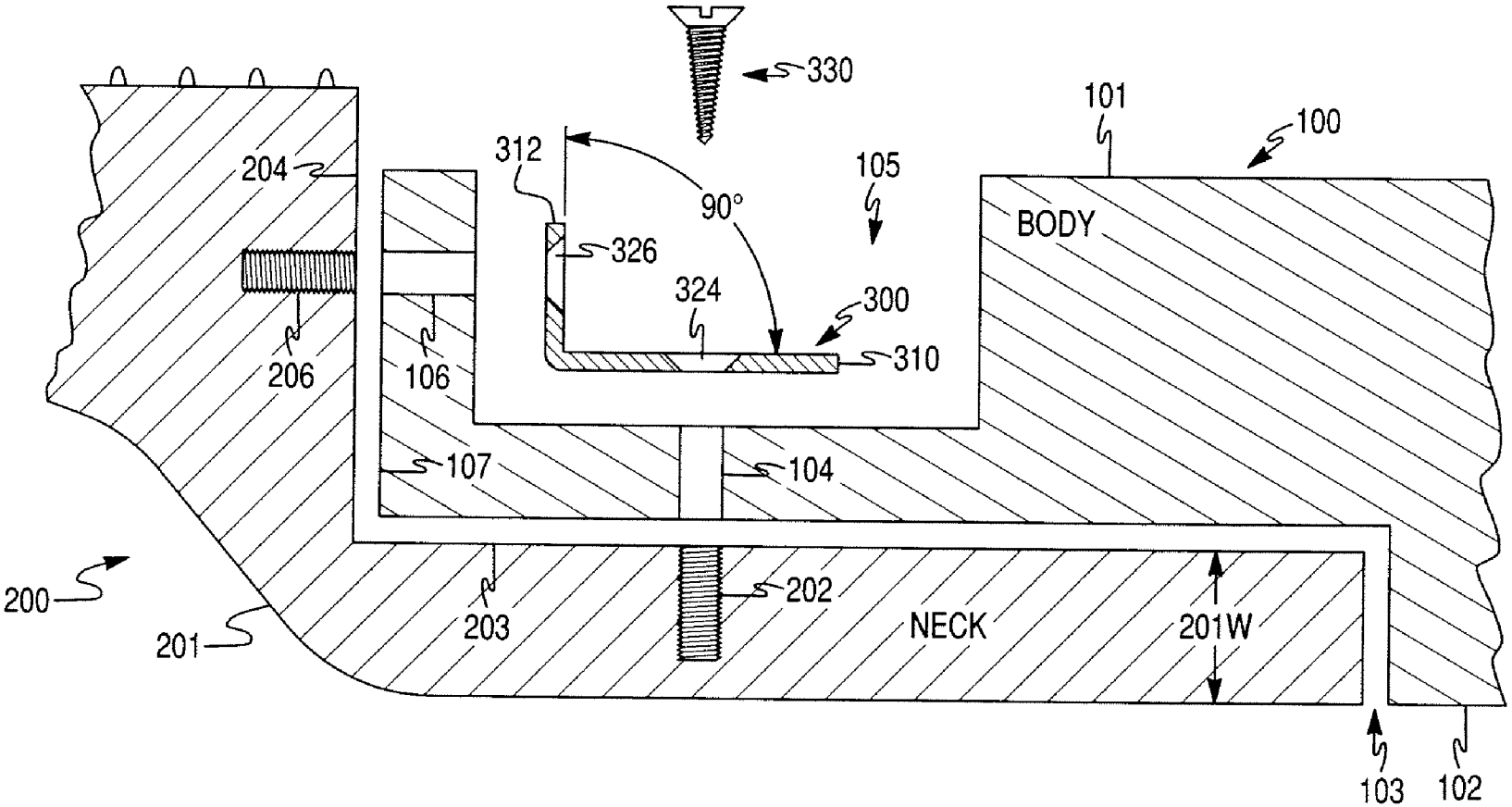
FIG. 1A depicts a cross-section side view of a bracket as it might be aligned against a neck and body of an instrument in accordance with first embodiment of the invention.

FIG. 1A provides a side view of the connection system in accordance with an embodiment of the present invention. More specifically, FIG. 1A shows a cross-section of a bracket 300 as it might be aligned against a neck 200 and a body 100 of stringed musical instrument in accordance with an embodiment of the invention. The body 100 is generally solid and has generally flat front surface 101 and rear surface 102. In alternative embodiments, the body 100 can include an interior cavity and/or can be constructed with any other body configuration known in the art. While the preferred embodiments of the invention are described in connection with an electric guitar, the present invention can be applied to all types of stringed instruments having one or more neck attached to a body.

The rear surface 102 of the body 100 is configured to receive a proximal end 201 of the neck 200. The rear surface of the body 100 preferably includes a recess 103 configured to receive a proximal end 201 of the neck 200. The proximal end 201 is preferably configured to snugly fit in the recess 103 when the neck 200 is attached to the body 100.

The proximal end 201 may include at least one pre-formed hole 202 in the surface 203 that extend partly through the width 201W of the proximal end 201 in a direction generally perpendicular to the surface 203. The neck 200 also may include at least one pre-formed hole 206 formed generally parallel (e.g., lengthwise) to the length of the neck 200 in the surface 204.

The body 100 also may include pre-formed holes 104 that are arranged in a similar pattern to the pre-formed holes 202. The pre-formed holes 104 preferably extend from the recess 103 to a cavity 105 formed below front surface 101. Similarly, pre-formed holes 106 are arranged in a similar pattern to the pre-formed holes 206. The pre-formed holes 106 preferably extend from the surface 107 to the interior cavity 105. In the illustrated embodiment, one cavity 105 is shown, having two corresponding pre-formed holes. It is contemplated, however, that two or more cavities 105 could be used in other embodiments. In addition, while only an single pre-formed hole is shown in each direction of the cross sectional view of FIG. 1A, it should be understood that two or more pre-formed holes may be used. Other embodiments can include fewer pre-formed holes (as little as one) or more pre-formed holes.

Continuing with FIG. 1A, a bracket 300 is shown inserted into cavity 105. In the embodiment of FIG. 1A, the bracket 300 is substantially L-shaped, including a portion 310 essentially parallel to front surface 101 of body 100 and an extension 312 essentially perpendicular to surface 310. Preferably, the bracket 300 includes holes 324 and 326 that align with holes 104 and 106, respectively, that extend from cavity 105. Preferably, but not necessarily, the bracket 300 takes on a true L-shape, meaning the extension 312 of the bracket is perpendicular to the face portion 310 of the bracket. Such a bracket is depicted in the various views presented by FIGS. 2A and 2B. A securing member 330, may be used to secure the bracket 300, neck 200 and body 100. The securing member 330 may extend through the pre-formed holes in the bracket and body and partly into said proximal end of the neck. Although only one securing member 330 is shown in FIG. 1A, it should be understood that a securing member will typically be provided for each set of pre-formed holes.

Extension 312 may extend into, around, against or through the surface of the body of the instrument and into, around, against or through the neck portion of the instrument adjacent to or within the body portion of the instrument. In one non-limiting example, while the L-shaped bracket 300 is shown internal to cavity 105, in other embodiments, a similar bracket may be included in between the surfaces of body 100 and neck 200. Alternatively, one or more brackets may be used in each location. Once installed, the cavity 105 with the securing members 330 and bracket 300 are covered using a cover plate (not shown) on the front side of the instrument to prevent visibility of the attachment components. The cover plate is most preferably a sound pick-up that is located within the pick-up cavity, but the cover could be virtually any other type of cover or material.

Figure 1B:
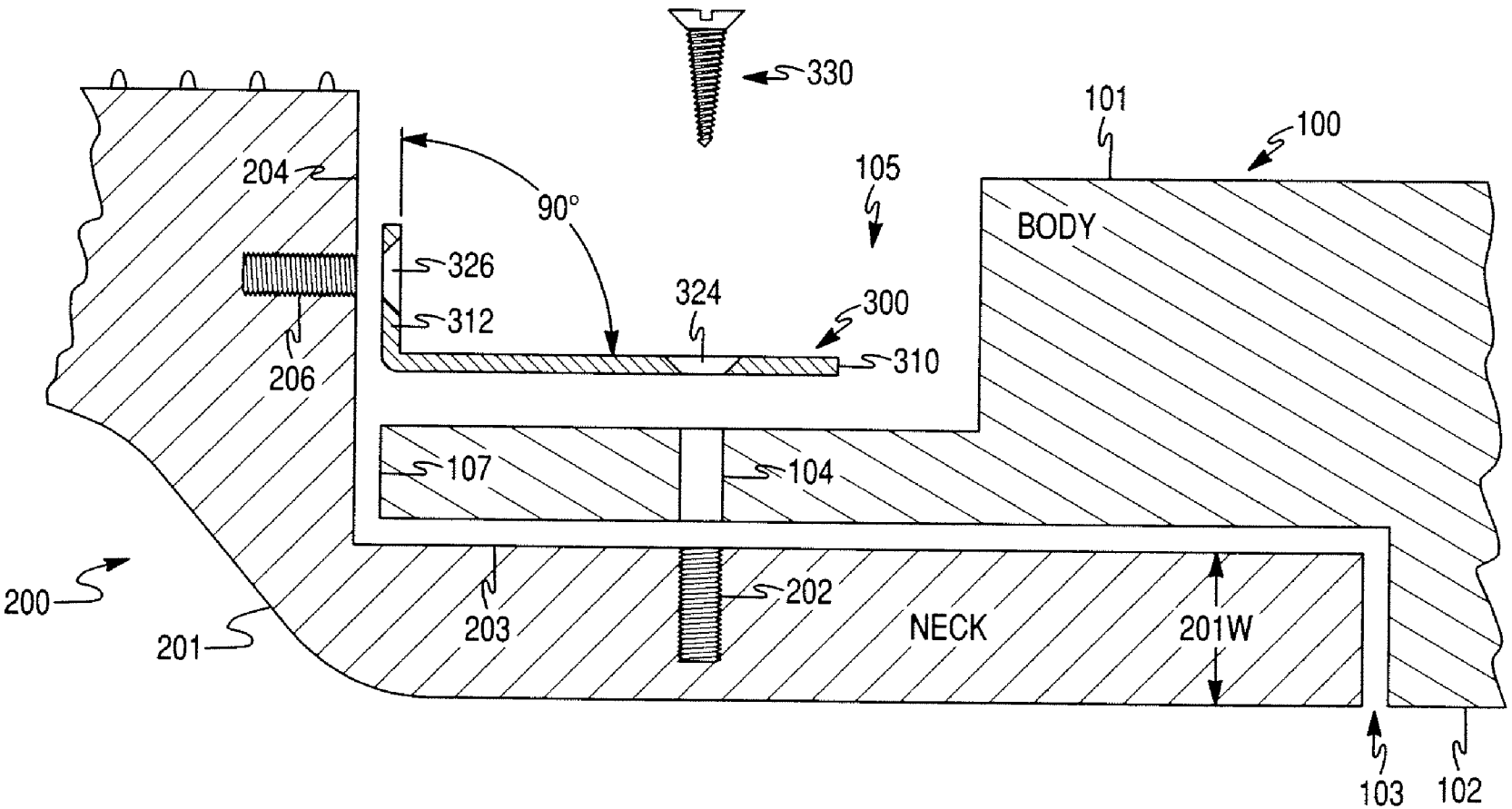
FIG. 1B depicts a cross-section side view of a bracket as it might be aligned against a neck and body of an instrument in accordance with second embodiment of the invention.

FIG. 1B provides a cross-section side view of a bracket as it might be aligned against a neck and body of an instrument in accordance with another embodiment of the invention. The elements of FIG. 1B are identical to that of FIG. 1A except that cavity 105 of body 100 is formed on one side by surface 204 of the neck 200, thus eliminating the need for pre-formed hole 106 (of FIG. 1A) and the portion of the body surrounding that hole. In other embodiments (not shown), cavity 105 may be eliminated completely so that the bracket 300 will be installed between the interface of the body and the neck.

Figure 2A:
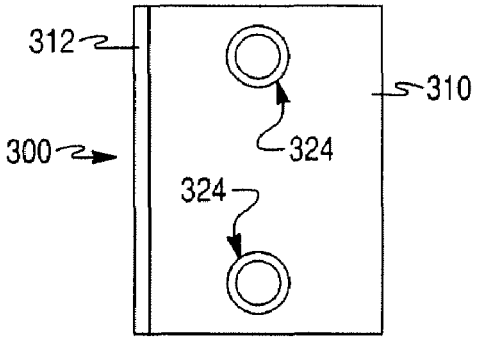
FIG. 2A depicts a front view of a bracket in accordance with an embodiment of the invention.
Figure 2B:
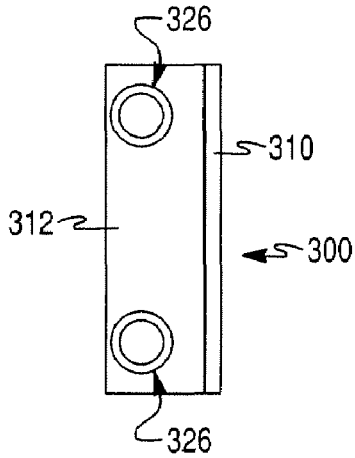
FIG. 2B depicts a side view of a bracket in accordance with the embodiment of FIG. 2A.

FIG. 2A provides a top view of the bracket 300 according to an embodiment of the invention. FIG. 2B provides a side view of bracket 300. The face portion 310 of the bracket is shown including two holes 324 to accommodate securing members 330. When bracket 300 is installed in cavity 105, the pattern of the holes 324 in face portion 310 and the holes 326 in extension 312 preferably are arranged to align with pre-formed holes 104 and 106, respectively, in cavity 105. The inclusion of the bracket 300 can, among other things, greatly enhance the structural characteristics of the neck/body interface. Among other benefits, the bracket (when secured with securing members 330, for example) helps prevent undesired separation of the neck and body, e.g., the surface 203 will be inhibited from sheering away from the recess 103 when forces are applied to the neck 200. The use of a single bracket with surfaces in more than one plane (e.g., perpendicular and parallel to the face 101) provides improved distribution of forces.

Bracket 300 is made from a made from a rigid, strong material such as metal or the like. Generally, any material providing greater strength and rigidity than the material of body 100 (which is may be made from wood) may provide some benefit. As one non-limiting example, bracket 300 may be made from 13 gauge cold rolled steel (CRS). The face portion 310 and extension 312 may be formed from a single piece of material, or, alternatively, the extension 312 may be secured to face portion 310 by suitable means, such as welding. The thickness of the face portion 310 and extension 312 of bracket 300 may vary depending upon the material used and the available space (e.g., the dimensions of recesses 105). For example, the bracket 300 made of 13 gauge CRS (about 0.09 in. U.S.G.) may provide suitable structural support. A smaller gauge or thicker material may be used for additional strength. Preferably, as shown in FIGS. 2A and 2B, the holes 324, 326 are counter-sinked to allow securing members 330 to be inserted flush with the surface of the bracket.

The face of the bracket 300 is preferably, but need not be, rectangular. Moreover, the apparent shape of the bracket 300, when viewed from the surface, need not correspond identically to the shape or positioning of the extension or extensions. Thus, the bracket 300 may appear oval on the surface of the instrument when installed, but may have extensions that extend from the bracket along a rectangular outline.

In an exemplary embodiment, the securing members 330 can be screws with threads having a diameter wider than the pre-formed holes 202, 206 (and/or 104, 106) so that the threads firmly connect to the body when screwed thereto. Alternatively, the holes 202, 206 (and/or 104, 106) can include pre-formed internal threads therein to receive corresponding threads in the screws, bolts or the like 330. As another alternative, the holes 202, 206 (and/or 104, 106) can include inserts to facilitate attachment to the screws, bolts or the like 310 (e.g., the inserts can include internally threaded nuts that can receive the screws or the like 330). In other less preferred embodiments, the securing members 330 can include dowels or pins that are press fit, glued and/or otherwise fixed between the neck 200 and body 100. Preferably, the securing members 330 are made from a rigid, strong material such as metal or the like.

Figure 3:
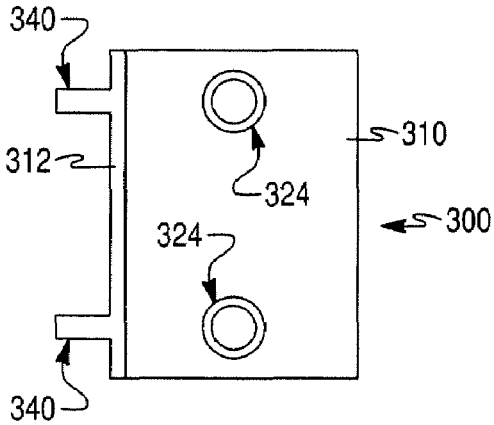
FIG. 3 depicts a front view of a bracket in accordance with another embodiment of the invention.
Figure 4:
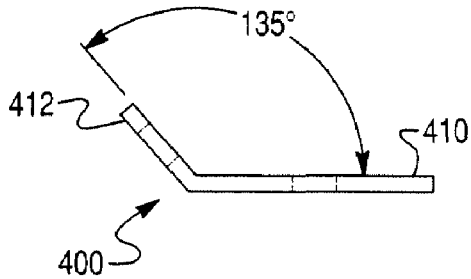
FIG. 4 depicts a side view of a bracket with a non-perpendicular extension in accordance with an embodiment of the invention.

Preferably, but not necessarily, the bracket takes on a true L-shape, meaning the extension of the bracket is perpendicular to the face of the bracket. Such a bracket is depicted in the various views presented by FIGS. 2A, 2B, and 3. Of course, the extension of the L-shaped bracket need not be perpendicular, as shown in FIG. 4. FIG. 4 provides a side view of an alternate embodiment of a bracket 400 for use in securing the neck to the body of a stringed instrument. An extension 412 projects at a non-perpendicular angle from face portion 410 of bracket 400. The angle of the extension 412 relative to face portion 410 can be varied, and is preferably identical to the angle of the neck-side wall of recess 105 (FIG. 1A) or of surface 204 (FIG. 1B) against which extension 412 is to be placed.

Referring back to FIG. 3, some embodiments of the present invention also may employ protrusions (such as pins or extrusions, for example) to provide additional strength and stability. Protrusions 340 may, for example, be positioned as shown in FIG. 3A formed on the neck-side of extension 312 of the bracket 300. Similarly, protrusions (not shown) may be formed on the bottom surface of face portion 310 either in place of or in addition to holes 324. The protrusions may be forced into the body and/or neck of the instrument. Of course, this and other attachment methods may be used in conjunction with one another or separately.

Figure 5A:
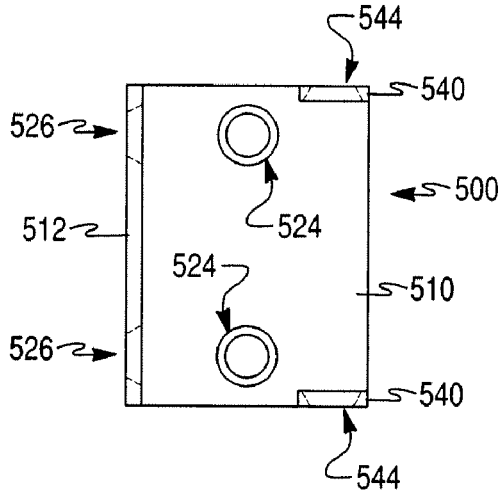
FIG. 5A depicts a front view of a bracket in accordance with another embodiment of the invention.
Figure 5B:
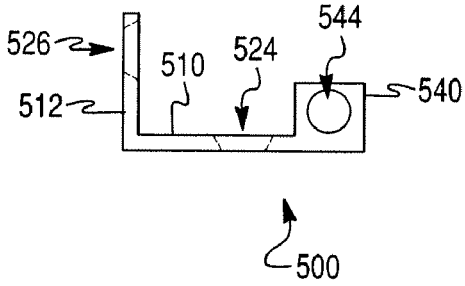
FIG. 5B depicts a side view of a bracket in accordance with the embodiment of FIG. 5A.
Figure 5C:
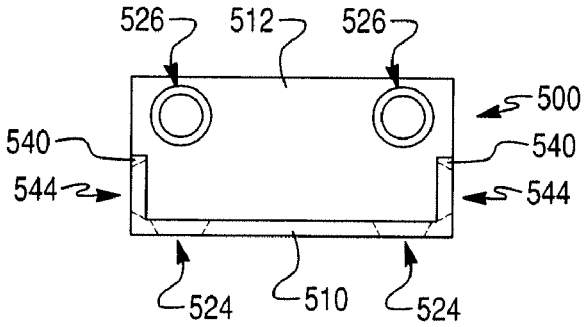
FIG. 5C depicts another side view of a bracket in accordance with the embodiment of FIG. 5A.

Other embodiments of the present invention may employ a bracket in which multiple distinct portions of the bracket extend away from the face of the bracket. Moreover, such extensions may be on multiple portions or sides of a bracket. For example, FIGS. 5A-C and FIGS. 6A-C provide additional embodiments of brackets with extensions on multiple portions or sides of a bracket. FIG. 5A depicts a front view of a bracket 500 in accordance with another embodiment of the invention. FIG. 5B depicts a side view of the bracket 500, and FIG. 5C depicts another side view of the bracket 500. Similar to the embodiment of FIG. 2A, the bracket 500 of FIG. 5 includes a face portion 510 and a primary extension 512 with holes 524 and 526 to receive securing members, such as screws. However, bracket 500 also includes additional extensions or tabs 540, which may be used to provide strengthening of the neck-body attachment in a different plane. Tabs 540 may be perpendicular to face portion 510 or at another angle. Tabs 540 may include holes 544 and/or protrusions (not shown) in a manner as previously described with respect to FIGS. 1A and 3A, respectively. While tabs 540 are shown in FIGS. 5A-C used in conjunction with a primary extension 512, the tabs may be used independent from the primary extension. The number of tabs is not limited by the configuration shown in FIGS. 5A-C, as greater or fewer tabs may be used.

Figure 6A:
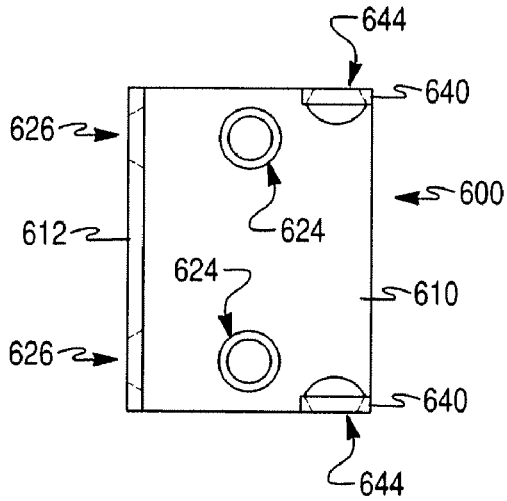
FIG. 6A depicts a front view of a bracket in accordance with another embodiment of the invention.
Figure 6B:
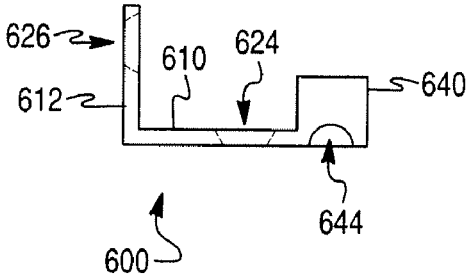
FIG. 6B depicts a side view of a bracket in accordance with the embodiment of FIG. 6A.
Figure 6C:
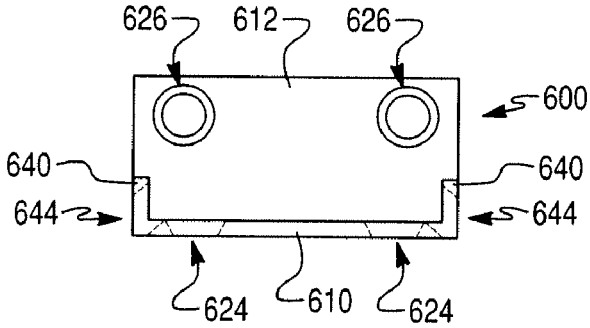
FIG. 6C depicts another side view of a bracket in accordance with the embodiment of FIG. 6A.

FIG. 6A depicts a front view of a bracket 600 in accordance with another embodiment of the invention. FIG. 6B depicts a side view of a bracket 600, and FIG. 6C depicts another side view of a bracket 600. The bracket 600 includes a face portion 610 and a primary extension 612 with holes 624 and 626 to receive securing members, such as screws. Tabs 640 are formed perpendicular to the face portion 610. Holes 640 are provided at a non-perpendicular angle to the tabs 640. In the embodiment of FIG. 6, the non-perpendicular holes are centered through the intersecting joint of tab 640 and face portion 610. In other variations, holes 640 may be include entirely within the tab 640 surface.

Figure 7:
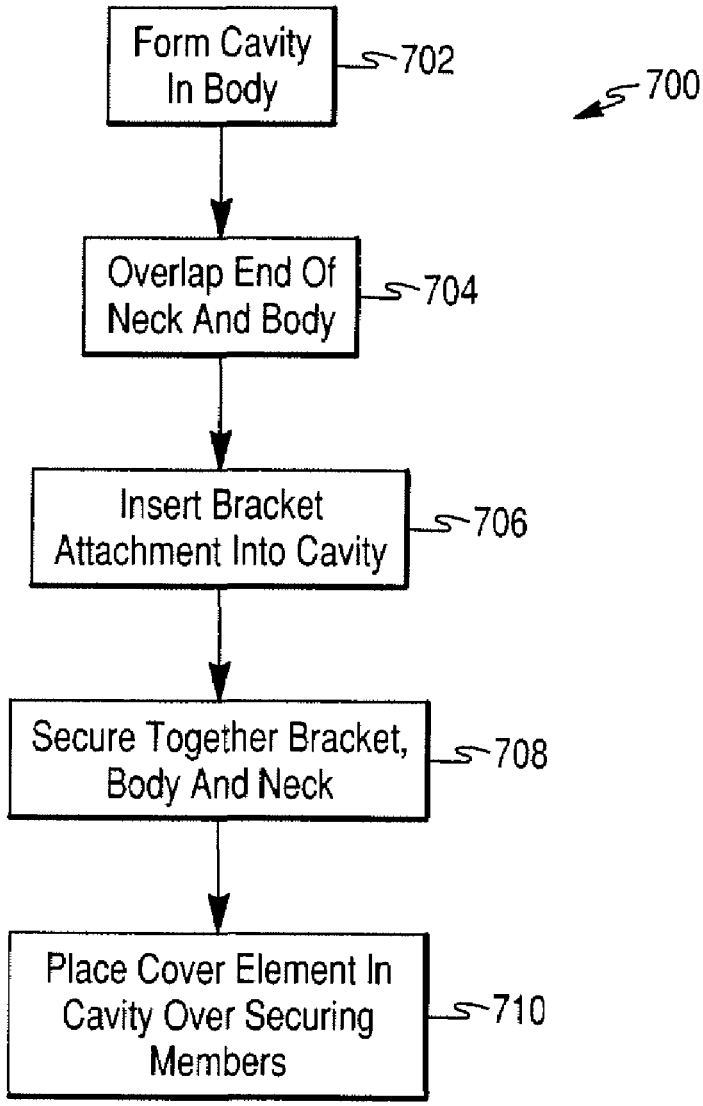
FIG. 7 provides a flow chart for a method for securing a body portion and an elongated neck of a stringed instrument in accordance with the invention.

FIG. 7 provides a flow chart for a method 700 for securing a body portion and an elongated neck of a stringed instrument in accordance with the invention. In step S702, a cavity is formed in the body portion of a musical instrument, the cavity extending to the front surface of the body. In step S704, the proximal end of the neck is overlapped with the body such that the proximal end extends behind said cavity. In step S706, a supporting bracket with at least one extension is inserted into the cavity in the body. In step S708, the bracket, the body and the neck are connected using at least one securing member (such as, for example, a screw or bolt) that extends from said cavity through the bracket and body and partly into the proximal end of the neck. In step S710, a cover element is paced within or over the cavity and over the securing members so as to have the front and rear surfaces of said body and neck free of visible securing members. As previously noted, the cover element may be a functional device, such a sound pick-up for an electric stringed instrument.

Of course, the invention disclosed herein may, if desired, be applied to or combined with the features disclosed in U.S. Pat. No. 6,262,353. The aspects and other advantages of the invention will be realized and attained by the structure particularly pointed out in the written description hereof. It is to be understood that both the foregoing general description and detailed description are exemplary and explanatory and are intended to provide further explanation of the invention as will be later claimed.

The invention claimed is:

1. A method for securing a body portion and an elongated neck of a stringed instrument, including:

forming a cavity in said body extending to a front surface of said body;

overlapping a proximal end of said neck and said body such that the proximal end of the neck extends behind said cavity;

aligning a bracket attachment having at least one non-planar extension with said cavity;

connecting at least one securing member that extends from said cavity through said bracket attachment and said body and partly into said proximal end for attaching said neck to said body; and placing a cover element within said cavity over said bracket attachment and said securing members so as to have the front and rear surfaces of said body and neck free of visible securing members.

2. The method of claim 1, further comprising the steps of:

pre-forming one or more holes partly through the width of the proximal end; and pre-forming one or more holes through said body so that the holes in said body align with the holes in said proximal end.

3. The method of claim 2, wherein the bracket attachment includes pre-formed holes, and said method further comprises the step of aligning the pre-formed holes of the bracket with the pre-formed holes of the body.

4. The method of claim 1, wherein the bracket attachment is substantially L-shaped.

5. The method of claim 1, wherein the bracket contains three or more non-planar extensions and wherein each non-planar extension has a securing member passing therethrough.

6. The method of claim 1, wherein the bracket attachment is aligned inside the cavity.

7. The method of claim 1, wherein the bracket attachment is located between the body and the proximal end of the neck.

8. The method of claim 1, wherein the securing member is a screw inserted flush with the surface of the bracket attachment.

9. The method of claim 1, wherein the bracket attachment is made of steel.

10. A system for a use in securing a body portion and an elongated neck of a stringed instrument, said system comprising:

a cavity formed within the body portion;

a bracket having at least one non-planar extension;

two or more securing members extending from the cavity through said body and bracket in separate planes so as to secure together said body, said neck and said bracket; and a cover element that fits within or over said cavity so as to have the front and rear surfaces of said body and neck free of visible securing members.

11. The system of claim 10, wherein the neck includes more or more pre-formed holes extending partly through the width of the neck, said pre-formed holes being generally aligned with said cavity.

12. The system of claim 11, wherein the cavity includes one or more pre-formed holes generally aligned with the pre-formed holes extending partly through the width of the neck.

13. The system of claim 10, wherein the bracket attachment is substantially L-shaped.

14. The system of claim 10, wherein the bracket contains three or more non-planar extensions and wherein each non-planar extension has a securing member passing therethrough.

15. The system of claim 10, wherein the bracket is inside the cavity.

16. The system of claim 10, wherein the bracket attachment is located between the body and the proximal end of the neck.

17. The system of claim 10, wherein the bracket is made of steel.

18. The system of claim 11, wherein at least one of the pre-formed holes include threaded metal inserts.

19. A method of constructing a stringed instrument, comprising the steps of:

a) providing a body having a front surface, a rear surface, a bridge mounted on said front surface, and a cavity extending to said front surface between said bridge and one end of said body;

b) providing a separate neck, said neck having a narrowed proximal end;

c) inserting a substantially L-shaped bracket attachment into said cavity;

d) overlapping said proximal end of said neck and said body such that the proximal end extends behind said cavity;

e) connecting a plurality of securing members that extend from said cavity through at least two planes of said substantially L-shaped bracket and said body and partly into said proximal end for attaching said neck to said body;

f) placing a cover element within said cavity over said securing members; and g) forming the front and rear surfaces of said body and neck to be free of visible securing members.

20. The method of claim 19 wherein said instrument is an electric instrument and said cover element is a sound pick-up of said instrument.

* * * * *